US008640496B2

(12) United States Patent
Howard

(10) Patent No.: US 8,640,496 B2
(45) Date of Patent: Feb. 4, 2014

(54) METHOD AND APPARATUS FOR SEPARATING AIR

(75) Inventor: Henry Edward Howard, Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 1282 days.

(21) Appl. No.: 12/195,450

(22) Filed: Aug. 21, 2008

(65) Prior Publication Data

US 2010/0043490 A1 Feb. 25, 2010

(51) Int. Cl.
*F25J 3/00* (2006.01)

(52) U.S. Cl.
USPC ..... 62/646; 62/640; 62/643; 62/644

(58) Field of Classification Search
None
See application file for complete search history.

(56) References Cited

U.S. PATENT DOCUMENTS 4,254,629 A * 3/1981 Olszewski ..... 62/651
4,453,957 A 6/1984 Pahade et al.
5,049,173 A * 9/1991 Cormier et al. ..... 62/646
5,331,818 A * 7/1994 Rathbone ..... 62/646
5,682,764 A 11/1997 Agrawal et al.
5,685,173 A * 11/1997 De L'Isle et al. ..... 62/646
6,128,921 A 10/2000 Guillard et al.
6,227,005 B1 5/2001 Higginbotham et al.
6,397,631 B1 * 6/2002 Griffiths et al. ..... 62/646
6,651,460 B2 * 11/2003 O'Connor ..... 62/646
6,666,048 B1 * 12/2003 Brugerolle et al. ..... 62/644
6,945,076 B1 * 9/2005 Garnier et al. ..... 62/643
2003/0033832 A1 * 2/2003 Massimo et al. ..... 62/643
2003/0051504 A1 * 3/2003 Corduan et al. ..... 62/646
2008/0011015 A1 * 1/2008 Brugerolle et al. ..... 62/643

* cited by examiner

*Primary Examiner* — Frantz Jules
*Assistant Examiner* — Keith Raymond
(74) *Attorney, Agent, or Firm* — David M. Rosenblum

(57) ABSTRACT

Air separation method in which air is separated within cryogenic rectification processes conducted in first and second cryogenic air separation plants. The first cryogenic air separation plant is designed to produce an oxygen-rich product stream and the second cryogenic air separation plant is designed to produce an impure oxygen vapor stream. At least part of the impure oxygen vapor stream is introduced into a lower pressure column of the first cryogenic air separation plant and oxygen contained in such stream along with air separated within the first air separation plant is used in producing the oxygen-rich product stream.

10 Claims, 2 Drawing Sheets

METHOD AND APPARATUS FOR SEPARATING AIR

FIELD OF THE INVENTION

The present invention relates to a method and apparatus for air separation in which cryogenic air separation plants are integrated to increase oxygen production. More particularly, the present invention relates to such a method and apparatus in which a first cryogenic air separation plant produces an oxygen-rich product stream and an impure oxygen vapor stream, produced by a second cryogenic air separation plant, is introduced into the lower pressure column of the first cryogenic air separation plant thereby increasing oxygen production.

BACKGROUND OF THE INVENTION

There exists an increasing, need to generate very large quantities of oxygen through the cryogenic separation of air. For example in some gasification projects upwards of between about 10,000 and about 15,000 metric tons per day of oxygen are required. Typically, as plant production size increases the associated distillation column diameter is also increased to be able to distill a larger mass flow rate of air. In this regard, typically distillation diameter increases in proportion to the square root of plant capacity. However, there are practical limitations on column diameter given the fact that distillation columns are typically fabricated off site and shipped to their destination.

When column diameters are in a range of between about 6.0 and 6.5 meters, shipping limitations arise. The consequence of this is that the oxygen production capability of a single cryogenic air separation plant that is greater than about 5,000 metric tons per day becomes very impractical. Due to this sizing constraint, parallel air separation plants are fabricated. However, the construction of additional columns for such air separation plants carries with it a considerable expense.

More specifically, large quantities of oxygen are produced within cryogenic air separation plants that employ double column arrangements of a higher pressure column and a lower pressure column. In such a plant, the air is compressed, purified and cooled to a temperature suitable for its distillation. The air is then introduced into the higher pressure column. Within the higher pressure column, the introduction of the air produces an ascending vapor phase that becomes evermore rich in nitrogen and a descending liquid phase that becomes evermore rich in oxygen. At the top of the high pressure column, a nitrogen-rich vapor column overhead is produced that is condensed to initiate the formation of the descending liquid phase. Additionally, a stream of the condensate is used to reflux the lower pressure column and initiate a descending liquid phase within such column.

Within the higher pressure column, a kettle liquid or a crude-liquid oxygen is produced that is introduced into the lower pressure column for further refinement. This produces an oxygen-rich column bottoms from which a stream may be taken as an oxygen product. The higher and lower pressure columns may be thermally linked by a condenser-reboiler that can be located at or near the base of the lower pressure column to condense the nitrogen-rich vapor overhead of the higher pressure column against vaporizing the oxygen-rich liquid.

In the double column arrangement, above the point at which the crude-liquid oxygen or kettle liquid is introduced, a limitation or bottleneck is produced in which for a given column size, any increase in mass flow rate of the air feed to the plant will cause the column to flood. Thus, for maximum column diameter of between about 6 and about 6.5 meters, the production of an oxygen product is limited to about 5,000 metric tons per day.

In the prior art, there have been integrations involving two separate cryogenic air separation plants with the object of increasing the production of a product produced by the cryogenic air separation plants. For example, in U.S. Pat. No. 6,666,048 an integration is shown in which a single column nitrogen generation plant is integrated with a double column oxygen producing plant by introducing a waste stream into the incoming air stream. In the single column nitrogen generator, a stream of the column bottoms that is rich in oxygen is introduced into a heat exchanger that is used to condense reflux for such column. The resulting vaporized stream produces the waste stream. However, while this may increase the flow of air into the double column, the resulting plant is not debottlenecked because the same limitation with respect to the flow above the point of introduction of the kettle liquid still exists. Consequently, the degree of increase in the oxygen production that can be obtained from such integration is very limited.

As will be discussed, the present invention provides an integration of two cryogenic air separation plants in which oxygen production can be increased to a larger extent than is possible in the prior art and also in a manner that allows energy savings to be realized.

SUMMARY OF THE INVENTION

The present invention provides a method of separating air. In accordance with such method, the air within a first air stream is separated by a first cryogenic rectification process. The first cryogenic rectification process employs a higher pressure column and a lower pressure column. An oxygen-rich product stream is withdrawn from the lower pressure column and is made up of an oxygen-rich liquid column bottoms produced in the lower pressure column. The air is also separated within a second air stream by a second cryogenic rectification process such that an impure oxygen vapor stream is produced having an oxygen concentration between that of the oxygen-rich product stream and the air and a lower nitrogen concentration than the air. At least part of the impure oxygen vapor stream that is produced by the second cryogenic rectification process is introduced into the lower pressure column of the first cryogenic rectification process. As a result, oxygen contained within the first air stream and the impure oxygen vapor stream is recovered in the oxygen-rich liquid column bottoms of the lower pressure column and is used in producing the oxygen-rich product stream.

Since the oxygen is recovered from both the impure oxygen vapor stream and the air contained within the first air stream the production of the oxygen-rich liquid column bottoms and therefore, the rate at which the oxygen-rich product stream can be withdrawn are increased. Since the nitrogen content of such impure oxygen vapor stream is lower than that of air, such stream can be added without exceeding operational flooding limitations of the lower pressure column thus alleviating the capacity bottleneck. This is to be contrasted with such prior art integrations such as have been discussed above in which, in effect, the flow of air introduced into a double column system is increased. Since such increased flow will increase the flow of nitrogen throughout such column system, flooding limitations within the lower pressure column will prevent an increase in oxygen production to the same degree as that obtainable by the present invention. Moreover, since in the present invention, such stream is being introduced in an impure state it can be produced at lower operational expense so that overall energy savings can be realized.

A stream of the oxygen-rich liquid column bottoms can be pumped to produce a pumped oxygen containing stream. At least part of the pumped oxygen containing stream can be vaporized within the first cryogenic rectification process, thereby to produce the oxygen-rich product stream. The term "vaporized" as used herein and in the claims includes a process in which a supercritical liquid stream is warmed as well as a change in state from a liquid to a vapor.

The first air stream and the second air stream can be fully cooled within a first main heat exchanger and a second main heat exchanger, respectively. Such main heat exchangers are used in connection with the first and second cryogenic rectification processes. The impure oxygen vapor stream derived from the second cryogenic rectification process can be fully warmed within the second main heat exchanger and then the at least part of the impure oxygen vapor stream can be fully cooled within the first main heat exchanger prior to being introduced into the lower pressure column of the first cryogenic rectification process. It is appropriate to point out that as used herein and in the claims, the term "fully cooled" means cooled to a temperature at the cold end of a main heat exchanger and "fully warmed" means warmed to a temperature at the warm end of the main heat exchanger.

The second cryogenic rectification process can produce a nitrogen product stream. This will allow the entire installation to meet the requirements of an energy related project, for instance, coal gasification wherein the oxygen is required at high pressure in order to facilitate gasification while the nitrogen can be added to a gas turbine that utilizes the fuel produced by gasification to lower Nox and to increase power.

The first cryogenic rectification process can employ a first higher pressure column and a first lower pressure column. The second cryogenic rectification process can employ a second higher pressure column and a second lower pressure column. An impure oxygen liquid column bottoms and a nitrogen-rich vapor overhead are produced in the second lower pressure column. A nitrogen-rich vapor stream composed of the nitrogen-rich vapor can be withdrawn from the lower pressure column and divided into first and second nitrogen-rich vapor streams. The first of the nitrogen-rich vapor streams can be fully warmed, thereby to form the nitrogen product stream. The second of the nitrogen-rich vapor streams can be liquefied and introduced into the lower pressure column as reflux. A liquid column bottoms stream composed of the impure oxygen liquid column bottoms is reduced in pressure and passed in indirect heat exchange with the second of the nitrogen-rich vapor stream thereby liquefying the second of the nitrogen-rich vapor streams and vaporizing the liquid column bottoms stream. The liquid column bottoms stream after having been vaporized can be fully warmed thereby to form the impure oxygen vapor stream. The at least part of the impure oxygen vapor stream can be fully cooled before being introduced into the first lower pressure column.

In another aspect, the present invention provides an apparatus for separating air. In accordance with this aspect of the present invention, a first cryogenic air separation plant is provided that has a higher pressure column and a lower pressure column. The first cryogenic air separation plant is configured to separate the air from oxygen from a first air stream and to produce an oxygen-rich product stream made up of an oxygen-rich liquid column bottoms of the lower pressure column that contains oxygen recovered from the first air stream and from an impure oxygen vapor stream introduced into the lower pressure column. A second cryogenic air separation plant is configured to separate the air within a second air stream such that an impure oxygen stream is produced having an oxygen concentration between that of the oxygen-rich product stream and a nitrogen concentration lower than the air. The first cryogenic air separation plant is connected to the second cryogenic air separation plant such that at least part of the impure oxygen vapor stream produced by the second cryogenic air separation plant is introduced into the lower pressure column of the first cryogenic air separation plant.

The first cryogenic air separation plant can have a pump interposed between the main heat exchanger and the lower pressure column so that a stream of the oxygen-rich liquid column bottoms is mechanically pumped to produce a pressurized oxygen containing stream. At least part of the pumped oxygen containing stream is vaporized within the main heat exchanger, thereby to produce the oxygen-rich product stream.

The first and second cryogenic air separation plants can be provided with a first and second main heat exchanger, respectively. The first cryogenic air separation plant and the second cryogenic air separation plant can be connected such that impure oxygen vapor stream is fully warmed within the second main heat exchanger and then the at least part of the impure oxygen vapor stream is fully cooled within the first main heat exchanger prior to being introduced into the lower pressure column of the first cryogenic rectification plant.

The second cryogenic air separation plant can be configured to produce a nitrogen product stream. In such case, the higher pressure column and the lower pressure column and a main heat exchanger of the first cryogenic air separation plant are a first higher pressure column, a first lower pressure column and a first main heat exchanger. The second cryogenic air separation plant can employ a second higher pressure column, a second lower pressure column and a second main heat exchanger. The second cryogenic air separation plant is configured such that an impure oxygen liquid column bottoms and a nitrogen-rich vapor overhead are produced in the second lower pressure column. The second main heat exchanger is connected to the second lower pressure column such that a first nitrogen-rich vapor stream that is composed of a nitrogen-rich overhead is fully warmed within the second main heat exchanger, thereby to form the nitrogen product stream. A heat exchanger can be connected to the lower pressure column such that a second nitrogen-rich vapor stream that is composed of the nitrogen-rich vapor column overhead is liquefied and introduced into the lower pressure column as reflux. A liquid column bottom stream composed of the impure oxygen liquid column bottoms is passed in indirect heat exchange with the second of the nitrogen-rich vapor streams, thereby liquefying the second of the nitrogen-rich vapor stream and vaporizing the liquid column bottoms stream. This heat exchanger is connected to the main heat exchanger such that the liquid column bottom stream after having been vaporized is fully warmed, thereby to form the impure oxygen vapor stream. The second main heat exchanger is connected to the first main heat exchanger so that the at least part of the impure oxygen vapor stream is fully cooled within the first main heat exchanger before being introduced into the first lower pressure column.

BRIEF DESCRIPTION OF THE DRAWINGS

While the specification concludes with claims distinctly pointing out the subject matter that Applicant regards as his invention it is believed that the invention will be better understood when taken in connection with the accompanying drawings in which:

DETAILED DESCRIPTION

Figure 1:
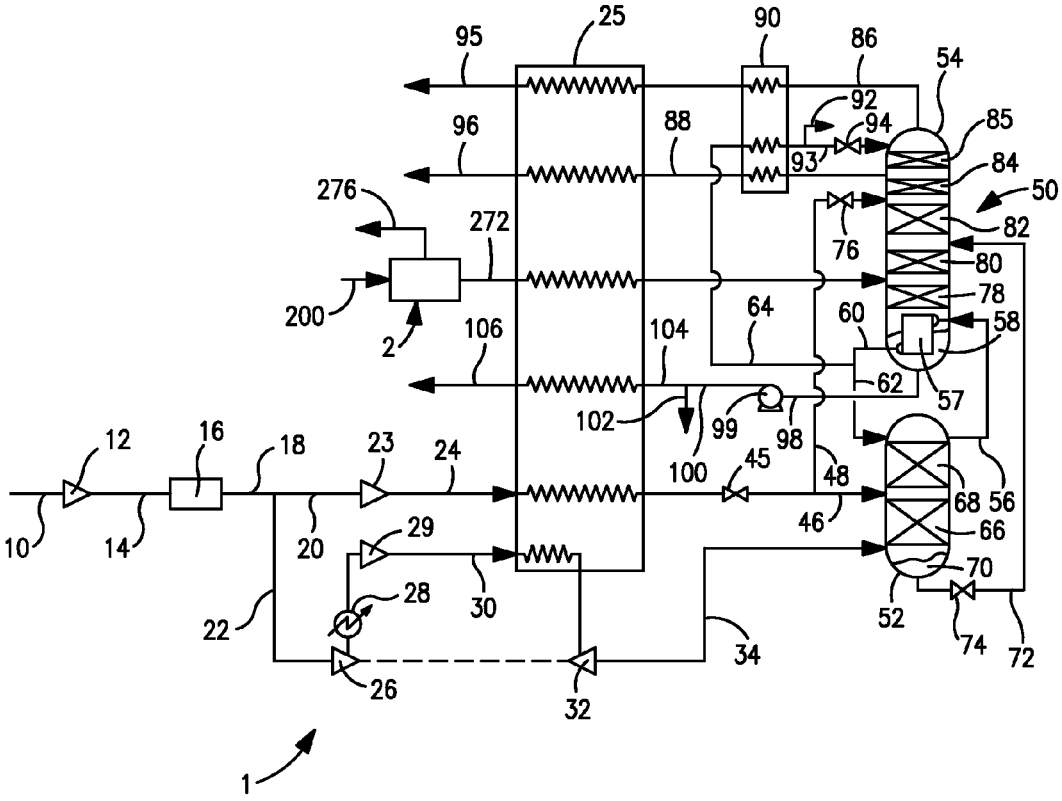
FIG. 1 is an integration of two cryogenic air separation plants for carrying out a method in accordance with the present invention.

With reference to FIG. 1, a cryogenic air separation plant 1 is illustrated that is integrated with a cryogenic air separation plant 2 to be discussed hereinafter to increase production of an oxygen product stream 106 of cryogenic air separation plant 1.

A first air stream 10 is introduced into a cryogenic air separation plant 1 to separate nitrogen from oxygen. First air stream 10 is compressed within a first compressor 12 to a pressure that can be between about 5 bar(a) and about 15 bar(a). Compressor 12 may be an intercooled, integral gear compressor with condensate removal that is not shown.

After compression, the resultant compressed feed stream 14 is introduced into a prepurification unit 16. Prepurification unit 16 as well known in the art typically contains beds of alumina and/or molecular sieve operating in accordance with a temperature and/or pressure swing adsorption cycle in which moisture and other higher boiling impurities are adsorbed. As known in the art, such higher boiling impurities are typically, carbon dioxide, water vapor and hydrocarbons. While one bed is operating, another bed is regenerated. Other processes could be used such as direct contact water cooling, refrigeration based chilling, direct contact with chilled water and phase separation.

The resultant compressed and purified feed stream 18 is then divided into a stream 20 and a stream 22. Typically, stream 20 is between about 25 percent and about 35 percent of the compressed and purified feed stream 18 and as illustrated, the remainder is stream 22.

Stream 20 is then further compressed within a compressor 23 which again may comprise intercooled, integral gear compression. The second compressor 23 compresses the stream 20 to a pressure between about 25 bar(a) and about 70 bar(a) to produce a first compressed stream 24. The first compressed stream 24 is thereafter introduced into a first main heat exchanger 25 where it is cooled and liquefied at the cold end of first main heat exchanger 25.

Stream 22 is further compressed by a turbine loaded booster compressor 26. After removal of the heat of compression by preferably, an after cooler 28, such stream is yet further compressed by a second booster compressor 29 to a pressure that can be in the range from between about 20 bar(a) to about 60 bar(a) to produce a second compressed stream 30. Second compressed stream 30 is then introduced into first main heat exchanger 25 in which it is partially cooled to a temperature in a range of between about 160 and about 220 Kelvin and is subsequently introduced into a turboexpander 32 to produce an exhaust stream 34 that is introduced into the air separation unit 50. As can be appreciated, the compression of stream 22 could take place in a single compression machine. As illustrated, turboexpander 32 is linked with first booster compressor 26, either directly or by appropriate gearing. However, it is also possible that turboexpander be connected to a generator to generate electricity that could be used on-site or routed to the grid.

After the first compressed stream 24 has been cooled within main heat exchanger 25, it is expanded in an expansion valve 45 into a liquid and divided into liquid streams 46 and 48 for eventual introduction into the air separation unit 50. Expansion valve 45 could be replaced by a liquid expander to generate part of the refrigeration.

The aforementioned components of the feed stream 10, oxygen and nitrogen, are separated within a distillation column unit 50 that consists of a higher pressure column 52 and a lower pressure column 54. It is understood that if argon were a necessary product, an argon column could be incorporated into the distillation column unit 50. Higher pressure column 52 operates at a higher pressure than lower pressure column 54. In this regard, lower pressure column 54 typically operates at between about 1.1 to about 1.5 bar(a).

The higher pressure column 52 and the lower pressure column 54 are in a heat transfer relationship such that a nitrogen-rich vapor column overhead extracted from the top of higher pressure column 52 as a stream 56 is condensed within a condenser-reboiler 57 located in the base of lower pressure column 54 against boiling an oxygen-rich liquid column bottoms 58. The boiling of oxygen-rich liquid column bottoms 58 initiates the formation of an ascending vapor phase within lower pressure column 54. The condensation produces a liquid nitrogen containing stream 60 that is divided into streams 62 and 64 that reflux the higher pressure column 52 and the lower pressure column 54, respectively to initiate the formation of descending liquid phases in such columns.

Exhaust stream 34 is introduced into the higher pressure column 52 along with the liquid stream 4 for rectification by contacting an ascending vapor phase of such mixture within mass transfer contacting elements 66 and 68 with a descending liquid phase that is initiated by reflux stream 62. This produces a crude liquid oxygen column bottoms 70 and the nitrogen-rich column overhead that has been previously discussed. A stream 72 of the crude liquid oxygen column bottoms is expanded in an expansion valve 74 to the pressure of the lower pressure column 54 and introduced into such column for further refinement. In addition, an impure oxygen vapor stream 272 produced by first cryogenic air separation plant 2 in a manner to be discussed is cooled within first main heat exchanger 25 and then is introduced into lower pressure column at a point below that of the introduction of the stream 72 of the crude liquid oxygen. Second liquid stream 48 is passed through an expansion valve 76, expanded to the pressure of lower pressure column 54 and then introduced into lower pressure column 54.

Lower pressure column 54 is provided with mass transfer contacting elements 78, 80, 82, 84 and 85 that can be trays or structured packing or random packing or other known elements in the art. As stated previously, the separation produces an oxygen-rich liquid column bottoms 58 and a nitrogen-rich vapor column overhead that is extracted as a nitrogen product stream 86. Additionally, a waste stream 88 is also extracted to control the purity of nitrogen product stream 86. Both nitrogen product stream 86 and waste stream 88 are passed through a subcooling unit 90. Subcooling unit 90 subcools reflux stream 64. Part of reflux stream 64 as a stream 92 may optionally be taken as a liquid product and a remaining part 93 may be introduced into lower pressure column 54 after having been reduced in pressure across an expansion valve 94.

After passage through subcooling unit 90, nitrogen product stream 86 and waste stream 88 are fully warmed within first main heat exchanger 25 to produce a warmed nitrogen product stream 95 and a warmed waste stream 96. Warmed waste stream 96 may be used to regenerate the adsorbents within prepurification unit 16. In addition, an oxygen-rich liquid stream 98 is extracted from the bottom of the lower pressure column 54 that consists of the oxygen-rich liquid column bottoms 58. Oxygen-rich liquid stream 96 can be pumped by a pump 99 to form a pressurized oxygen containing stream 100. Part of the pressurized liquid oxygen stream 100 can optionally be taken as a liquid oxygen product stream 102. The remainder 104 can be fully warmed in first main heat exchanger 25 and vaporized to produce an oxygen product stream 106 at pressure.

The introduction of impure oxygen vapor stream 272 into lower pressure column 54 will increase the amount of the oxygen-rich liquid column bottoms 58 produced in lower pressure column 54 over that produced from the separation of oxygen within first air stream 10 alone. Such stream can be added without substantially increasing the vapor loading lower pressure column 54 since, the nitrogen content of impure oxygen vapor stream 272 is less that that of air. This of course is not without limitation. As can be appreciated, for a given oxygen and nitrogen concentration of oxygen vapor stream 272, as the flow is increased, the air directed to the higher pressure column 52 generates a relatively fixed quantity of reflux stream 64 eventually there will be insufficient reflux to maintain high oxygen recovery from column 54.

Figure 2:
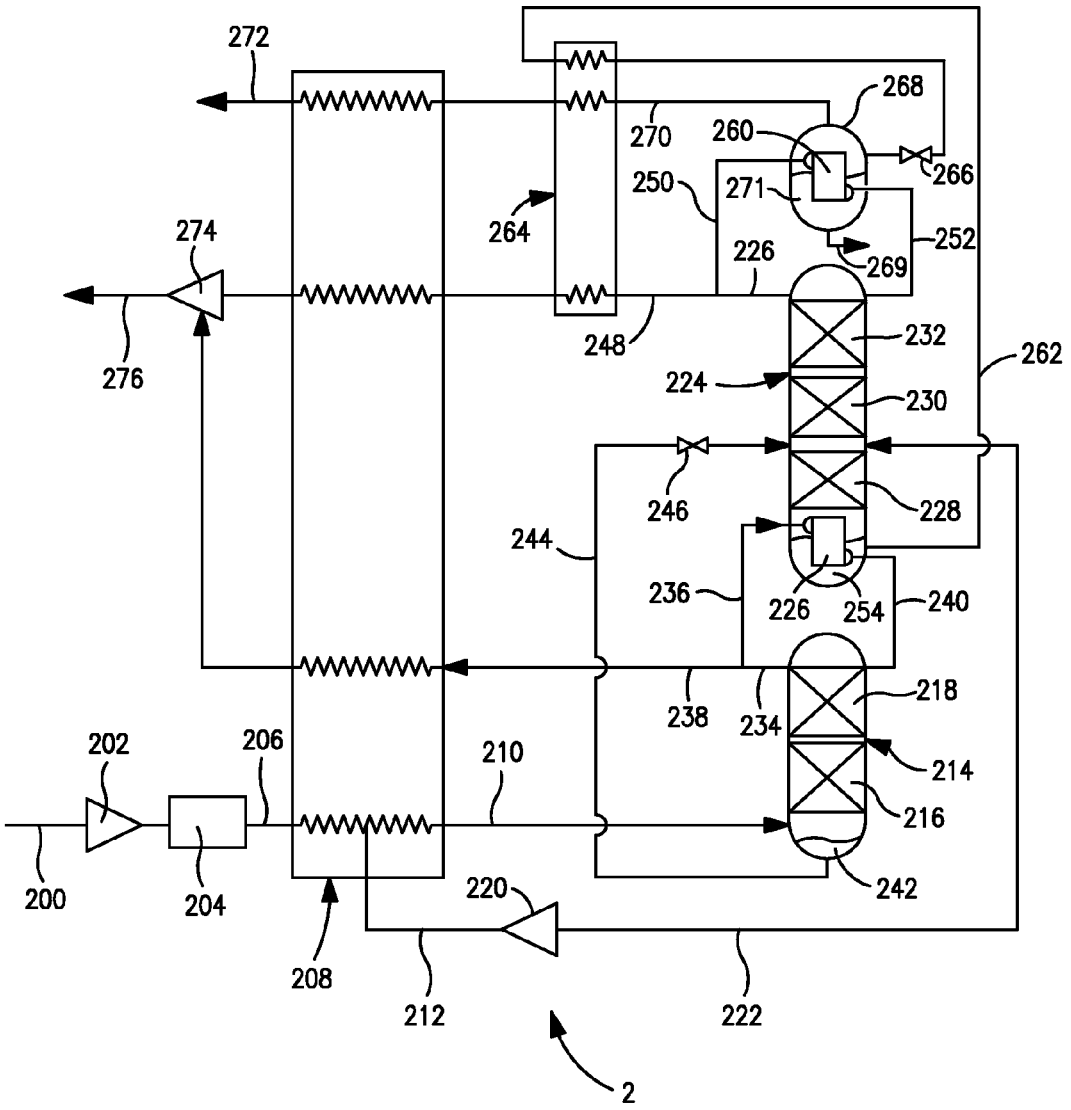
FIG. 2 is a schematic, process flow diagram of a cryogenic air separation plant utilized in FIG. 1 for producing an impure oxygen stream.

It is to be noted that although first air separation plant 1 is illustrated as having higher and lower pressure columns connected in a heat transfer relationship by provision of condenser-reboiler 57, other types of plants are possible. For example, low purity oxygen plants can be used in connection with the present invention. In such plants, the higher and lower pressure columns are not connected in a heat transfer as shown in FIG. 1. Rather, lowermost reboil of the lower pressure column is typically provided by the condensation or partial condensation of a compressed air stream that is afterwards fed into the higher pressure column. Additionally, although a lower column turbine 32 is illustrated, a plant design incorporating an upper column turbine is possible. Further, although first air separation plant 1 is designed to produce a high pressure oxygen product, the present invention has application to gaseous oxygen plants in which oxygen is produced at lower pressure and/or as liquid directly from the lower pressure column. With reference to FIG. 2 a second cryogenic air separation plant 2 is illustrated that is designed to generate nitrogen and that produces the impure oxygen stream 272 or in other words a stream that contains more oxygen than air but also an appreciable quantity of nitrogen. Second cryogenic air separation plant 2 is but one example of a plant that could be used to generate an impure oxygen stream. For example, single column nitrogen generators could be used and in such case, the impure oxygen vapor stream would be created from column bottoms liquid that is vaporized in the course of condensing reflux. Other examples include dual column cycles employing multiple condenser-reboilers. Further, cryogenic air separation plant 2 need not operate at the same pressure as cryogenic air separation plant 1. It could operate at a lower pressure resulting in an energy savings. Further, although cryogenic air separation plant 2 is of the type that is designed to produce a high purity nitrogen product, the particular unit used for cryogenic air separation plant 2 might be a lower purity unit.

Cryogenic air separation plant 2 separates the air within a second air stream 200. Second air stream 200 is compressed in a compressor 202 and then purified within a prepurification unit 204. Compressor 202 may constitute multiple stages of compression, intercooling and condensate removal. Prepurification unit 204 may be of the same type as prepurification unit 16.

The resulting compressed and purified air stream 206 is then introduced into main heat exchanger 208. A first subsidiary air stream 210, formed from part of compressed and purified air stream 206 is fully cooled and discharged from the cold end of main heat exchanger 208. A second subsidiary air stream 212 constituting a remaining part of compressed and purified air stream 206 is withdrawn from an intermediate point of main heat exchanger 208 and as such is partially cooled, between the warm and cold end temperatures of main heat exchanger 208.

First subsidiary air stream 210 is introduced into a second higher pressure column 214 that is provided with mass transfer contacting elements 216 and 218 to initiate the formation of an ascending phase that becomes evermore rich in nitrogen to produce a nitrogen-rich column overhead.

Second subsidiary air stream 212, that can have a flow rate of anywhere from between about 5 percent and about 20 percent of that of the second air stream 200, is expanded within an expander 220 to produce an exhaust stream 222 that is introduced into a lower pressure column 224 to impart refrigeration into the second cryogenic air separation plant 2. The second lower pressure column 224 is provided with a condenser-reboiler 226 and mass transfer contacting elements 228, 230 and 232. A stream of the nitrogen-rich vapor 234 taken from the higher pressure column 214 is divided into a first nitrogen vapor stream 236 and a second nitrogen vapor stream 238. First nitrogen vapor stream 236 is condensed within condenser-reboiler 226 to produce a liquid nitrogen-rich stream 240 that is used to reflux the higher pressure column 214 and to initiate the formation of a descending phase that becomes evermore rich in oxygen to produce a kettle liquid 242 in a bottom region of second higher pressure column 214. A kettle liquid stream 244 is expanded in a valve 246 to the pressure of second lower pressure column 224 and introduced at a level of the exhaust stream 222 to further refine the kettle liquid 242.

A second nitrogen-rich vapor tower overhead collects at the top of second lower pressure column 224 and is extracted as a second nitrogen-rich vapor stream 226. Second nitrogen-rich vapor stream 226 is divided into a second nitrogen product stream 248 and a second nitrogen-rich stream 250. Second nitrogen-rich stream 250 is condensed within a heat exchanger 260 to produce a second liquid nitrogen reflux stream 252 that is introduced into the top of the second lower pressure column 224 to initiate the formation of a descending liquid phase that becomes evermore more rich in oxygen to produce an impure oxygen-rich liquid column bottoms 254 in the bottom of the second lower pressure column 224.

A stream of the impure oxygen liquid column bottoms 262 is withdrawn from the bottom of second lower pressure column 224, subcooled within a subcooling unit 264, is valve expanded by valve 266 and is then introduced into a shell 268 that houses the heat exchanger 260 to condense the second nitrogen-rich vapor stream 250. This results in the vaporization of the impure oxygen-rich liquid 254 to produce the impure oxygen vapor stream 270 and a liquid 271 that contains less volatile components such as hydrocarbons that can be disposed through a drain 269 of shell 268 for safety considerations. Impure oxygen vapor stream 270 warms within subcooling unit 264 and then fully warms within second main heat exchanger 208 to produce the warmed impure oxygen vapor stream 272 for introduction into the first cryogenic air separation plant 1.

The second nitrogen vapor product stream 248 also warms within subcooling unit 264 to help subcool the impure oxygen-rich liquid stream 262 and then fully warms within main heat exchanger 208. The second nitrogen product stream 248 is then introduced into a nitrogen product compressor 274 for compression along with first nitrogen product stream 238 which also fully warms within main heat exchanger 208 and is introduced into an intermediate stage thereof being at a higher pressure than second nitrogen product stream 248. The compression produces a pressurized nitrogen product stream 276 that can be directly utilized for a downstream process such as the reduction of Nox within a gas turbine.

It is to be noted that the impure oxygen vapor stream 272 could be fed directly into cryogenic air separation plant 1 without having been fully warmed within the second main heat exchanger 208. Second air stream 200 can be derived from the first air stream 10 fed to the first cryogenic air separation plant. In this regard, second air stream 206 could be taken from the compression train associated with stream 18. In such case, there would be no need for compressor 202 or for prepurification unit 204. Alternatively, second main heat exchanger 208 and first main heat exchanger 25 could be integrated between the plants. Additionally, although cryogenic air separation plant 2 is illustrated as only supplying impure oxygen vapor stream 272 to cryogenic air separation plant 1, it could supply such stream to several other plants. In this regard, such other plants need not be the same in that one type of such plants may be capable of also generating argon while another type being served by the same impure oxygen plant might be designed to produce only oxygen and/or nitrogen products. In an enclave of plants there might be multiple linkages between plants to supply impure oxygen to some of the plants in the enclave.

Although the present invention has been described with reference to a preferred embodiment, as will occur to those skilled in the art, numerous changes, additions and omissions can be made without departing from the spirit and scope of the present invention as set forth in the appended claims.

I claim:

1. A method of separating air comprising:

separating the air within a first air stream by introducing the first air stream into a first cryogenic air separation plant, the first cryogenic air separation plant employing a first main heat exchanger to cool the first air stream, after having been compressed and purified, to a temperature suitable for the distillation of the air within the first air stream and a higher pressure column and a lower pressure column to distill the air within the first air stream;

withdrawing an oxygen-rich product stream from the lower pressure column, the oxygen-rich product stream being made up of an oxygen-rich liquid column bottoms produced in the lower pressure column;

separating the air within a second air stream in a second cryogenic air separation plant independently of the separating of the air within the first cryogenic air separation plant with the use of a second main heat exchanger to cool the second air stream, after having been compressed and purified separately from the first air stream, to a temperature suitable for the distillation of the air with the second air stream and at least one other distillation column to distill the air within the second air stream such that an impure oxygen vapor stream is produced having an oxygen concentration between that of the oxygen-rich product stream and the air and a lower nitrogen concentration than the air; and introducing at least part of the impure oxygen vapor stream produced by the second cryogenic air separation plant into the lower pressure column of the first cryogenic air separation plant such that the at least part of the impure oxygen vapor stream, upon introduction into the lower pressure column, has the oxygen concentration and the lower nitrogen concentration of the impure oxygen vapor stream produced by the second cryogenic air separation plant and oxygen contained within the first air stream and the impure oxygen vapor stream is recovered in the oxygen-rich liquid column bottoms of the lower pressure column and is used in producing the oxygen-rich product stream.

2. The method of claim 1, wherein:

a stream of the oxygen-rich liquid column bottoms is pumped to produce a pumped oxygen containing stream; and at least part of the pumped oxygen containing stream is vaporized within the first cryogenic rectification process, thereby to produce the oxygen-rich product stream.

3. The method of claim 1, wherein:

the impure oxygen vapor stream is fully warmed within the second main heat exchanger and then fully cooled within the first main heat exchanger prior to introduction of at least part of the impure oxygen vapor stream into the lower pressure column of the first cryogenic rectification process.

4. The method of claim 2, wherein the second cryogenic rectification process produces a nitrogen product stream.

5. The method of claim 4, wherein:

the higher pressure column and the lower pressure column of the first cryogenic air separation plant are a first higher pressure column and a first lower pressure column;

the at least one other distillation column of the second cryogenic air separation plant is a second higher pressure column and a second lower pressure column;

an impure oxygen liquid column bottoms and a nitrogen-rich vapor overhead are produced in the second lower pressure column;

a nitrogen-rich vapor stream composed of the nitrogen-rich vapor is withdrawn from the second lower pressure column and divided into first and second nitrogen-rich vapor streams;

the first of the nitrogen-rich vapor streams is fully warmed, thereby to form the nitrogen product stream;

the second of the nitrogen-rich vapor streams is liquefied and introduced into the lower pressure column as reflux;

a liquid column bottoms stream composed of the impure oxygen liquid column bottoms is reduced in pressure and passed in indirect heat exchange with the second of the nitrogen-rich vapor streams thereby liquefying the second of the nitrogen-rich vapor streams and vaporizing the liquid column bottoms stream;

the liquid column bottoms stream after having been vaporized is fully warmed, thereby to form the impure oxygen vapor stream; and the at least part of the impure oxygen vapor stream is fully cooled before being introduced into the first lower pressure column.

6. An apparatus for separating air comprising:

a first cryogenic air separation plant having first main heat exchanger to cool the first air stream, after having been compressed and purified to a temperature suitable for the distillation of the air within the first air stream and a higher pressure column and a lower pressure column, the first cryogenic air separation plant configured to separate the air within a first air stream and to produce an oxygen-rich product stream made up of an oxygen-rich liquid column bottoms of the lower pressure column containing oxygen recovered from the first air stream and from an impure oxygen vapor stream introduced into the lower pressure column;

a second cryogenic air separation plant configured to separate the air within a second air stream independently of the first cryogenic air separation plant and having a second main heat exchanger to cool the second air stream, after having been compressed and purified separately from the first air stream, to a temperature suitable for the distillation of the air with the second air stream and at least one other distillation column to distill the air within the second air stream such that the impure oxygen vapor stream is produced having an oxygen concentration between that of the oxygen-rich product stream and the air and a lower nitrogen concentration; and the first cryogenic air separation plant connected to the second cryogenic air separation plant such that at least part of the impure oxygen vapor stream, produced by the second cryogenic air separation plant, is introduced into the lower pressure column of the first cryogenic air separation plant and has the oxygen concentration and the lower nitrogen concentration of the impure oxygen vapor stream produced by the second cryogenic air separation plant upon introduction into the lower pressure column of the first cryogenic air separation plant.

7. The apparatus of claim 6 wherein the first cryogenic air separation plant has a pump interposed between the first main heat exchanger and the lower pressure column so that a stream of the oxygen-rich liquid column bottoms is pumped by the pump to produce a pumped oxygen containing stream and at least part of the pumped oxygen containing stream is vaporized within the main heat exchanger, thereby to produce the oxygen-rich product stream.

8. The apparatus of claim 6, wherein:

the first cryogenic air separation plant and the second cryogenic air separation plant are connected such that the impure oxygen vapor stream is fully warmed within the second main heat exchanger and then the at least part of the impure oxygen vapor stream is fully cooled within the first main heat exchanger prior to being introduced into the lower pressure column of the first cryogenic rectification plant.

9. The apparatus of claim 7, wherein the second cryogenic air separation plant is configured to produce a nitrogen product stream.

10. The apparatus of claim 9, wherein:

the higher pressure column and the lower pressure column and the main heat exchanger of the first cryogenic air separation plant are a first higher pressure column, a first lower pressure column;

the at least one other distillation column of the second cryogenic air separation plant is a second higher pressure column and a second lower pressure column;

the second cryogenic air separation plant is configured such that an impure oxygen liquid column bottoms and a nitrogen-rich vapor overhead are produced in the second lower pressure column;

the second main heat exchanger is connected to the second lower pressure column such that a first nitrogen-rich vapor stream composed of the nitrogen-rich vapor overhead is fully warmed within the second main heat exchanger, thereby to form the nitrogen product stream;

a heat exchanger is connected to the second lower pressure column such that a second nitrogen-rich vapor stream composed of the nitrogen-rich vapor column overhead is liquefied and introduced into the second lower pressure column as reflux and a liquid column bottoms stream composed of the impure oxygen liquid column bottoms is passed in indirect heat exchange with the second of the nitrogen-rich vapor streams, thereby liquefying the second of the nitrogen-rich vapor streams and vaporizing the liquid column bottoms stream;

the heat exchanger connected to the second main heat exchanger such that the liquid column bottoms stream after having been vaporized is fully warmed, thereby to form the impure oxygen vapor stream; and the second main heat exchanger connected to the first main heat exchanger so that the at least part of the impure oxygen vapor stream is fully cooled within the first main heat exchanger before being introduced into the first lower pressure column.

* * * * *